United States Patent [19]

Mabuchi

[11] 4,088,128

[45] May 9, 1978

[54] BEAUTY TREATMENT DEVICE

[75] Inventor: Kenichi Mabuchi, Tokyo, Japan

[73] Assignee: Mabuchi Motor Co., Ltd., Tokyo, Japan

[21] Appl. No.: 719,378

[22] Filed: Sep. 1, 1976

[30] Foreign Application Priority Data

| | | |
|---|---|---|
| Sep. 4, 1975 | Japan | 50-107600 |
| Oct. 16, 1975 | Japan | 50-141679 |

[51] Int. Cl.[2] ..... A61H 7/00

[52] U.S. Cl. ..... 128/52; 128/55

[58] Field of Search ..... 128/51-55, 128/24.2

[56] References Cited

U.S. PATENT DOCUMENTS

| | | | |
|---|---|---|---|
| 1,599,628 | 9/1926 | Ahlgren | 128/55 |
| 1,657,765 | 1/1928 | Pasque | 128/55 |
| 1,796,444 | 3/1931 | Dell'era et al. | 128/55 |
| 2,067,991 | 1/1937 | Taylor | 128/55 |
| 2,076,410 | 4/1937 | McGerry | 128/55 |
| 3,837,335 | 9/1974 | Teranishi | 128/52 |

*Primary Examiner*—Lawrence W. Trapp

[57] ABSTRACT

A beauty treatment device comprising a device body having a cylindrical or pistol-grip type handle and a space guide on its one end; a drive unit mounted in the device body and consisting of an electric motor, a reduction gear assembly and a rotating shaft; and energy accumulating means consisting of one or more springs and other members for accumulating energy delivered by the drive unit; an energy releasing means for releasing the accumulated energy by rotation of a rotating disc with rollers which is mounted on the rotating shaft; an actuating member driven by the energy accumulating means and the energy releasing means; and a plate member which has a T-shaped longitudinal section and is mounted on the actuating member, wherein the plate member which is maintained the range of its movement by the space guide and protruded from the end face of the space guide is constructed so as to lightly tap the skin covered by the end face of the space guide.

11 Claims, 10 Drawing Figures

BEAUTY TREATMENT DEVICE

BACKGROUND OF THE INVENTION

1. Field of the Invention

This invention relates generally to a beauty treatment device, and more specifically to a beauty treatment device having an actuating member which performs a reciprocating action in a space guide which maintains the range of the movement of the actuating member, wherein a plate member mounted on the actuating member taps the skin covered by the space guide to remove subcutaneous fat, to train subcutaneous muscular systems to prevent the skin from slackening, and the intensity of tapping action is positively controlled as necessary.

2. Description of the Prior Art

Well known beauty arts, particularly facial treatments include the method to stimulate the skin by repeatedly tapping or snapping the skin with fingertips to retain the youthfulness of the skin and to eliminate wrinkles on the skin. There have been known various beauty treatment devices such as a massaging device for massaging the skin by applying vibration to the skin and a shoulder tapper and similar tapping devices for tapping the body parts and the skin to relieve stress on the skin and to prevent the skin from slackening.

However, the above-mentioned vibration-type massaging device depresses or kneads the skin, causing the skin to stretch. This may result in further slackening of the skin. The abovementioned tapping device does not apply snapping or tapping action to the skin, but exerts an impact directly on subcutaneous muscles. Therefore, the tapping device has a drawback, as in the massaging device, in that it causes the skin to stretch, resulting in the slackening of the skin and wrinkles. For this reason, a need exists for a beauty treatment device which automatically and repeatedly taps the skin to remove subcutaneous fat and train subcutaneous muscular systems, preventing the skin from slackening.

SUMMARY OF THE INVENTION

An object of this invention is to provide a novel beauty treatment device which overcomes the above-mentioned drawback and realize the above-mentioned need.

Another object of this invention is to provide a beauty treatment device which repeatedly taps the skin and is capable of changing the intensity of tapping action or changing the surface area of a plate member, depending on the body part to be treated, for example, cheeks or the corner of the eyes.

Yet another object of this invention is to provide a beauty treatment device of such a construction that a plate member and a cushion member, both mounted on an actuating member, tap the skin while maintaining the distance between the device body and the skin by a space guide.

A further object of this invention is to provide a beauty treatment device in which the intensity of tapping action can be easily changed by changing the intensity and number of the energy accumulating means and the rate of tapping action can be easily changed by changing the rate of the energy release means.

A further object of this invention is to provide a beauty treatment device in which the disc member and the space guide is replaceable so that appropriate tapping action can be achieved by changing the surface area of the plate member, depending on the area to be treated.

Still a further object of this invention is to provide a beauty treatment device in which the rate of tapping action can be freely selected by adjusting the voltage supplied to the motor by means of a control box.

DETAILED DESCRIPTION OF THE EMBODIMENTS

Figure 1:
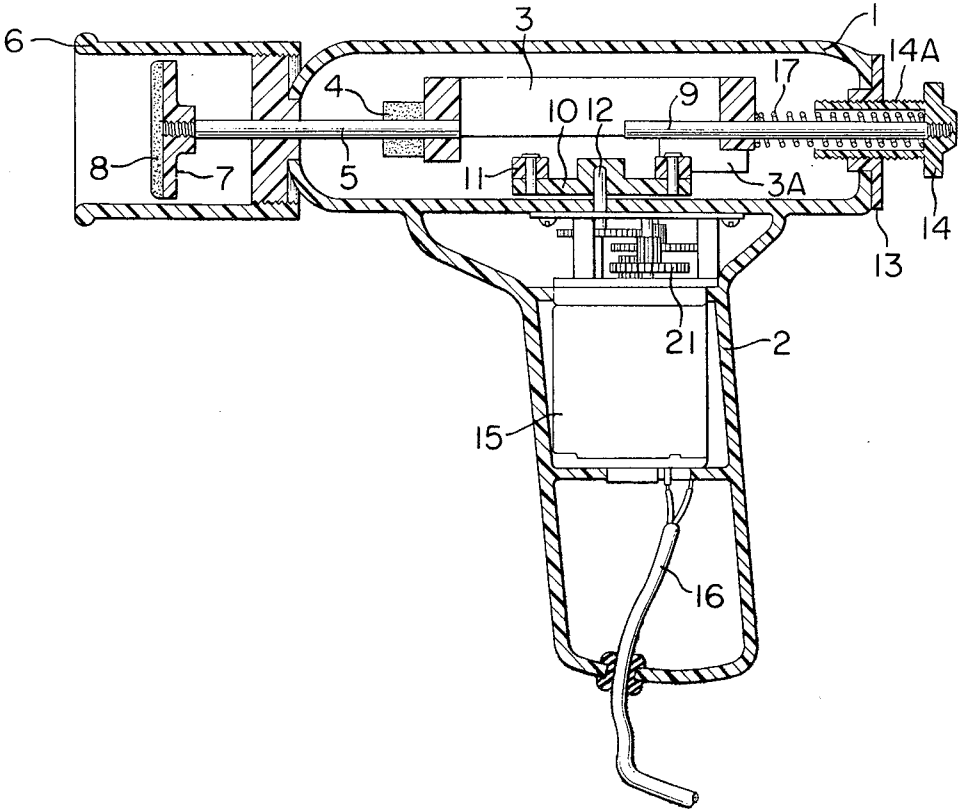
FIG. 1 is a cross section of a beauty treatment device embodying this invention.

In FIGS. 1 through 6, numeral 1 refers to a device body, 2 to a handle, 3 to a U-shaped connecting frame, 3A to a hook portion formed integrally with the connecting frame on the bottom surface of the connecting frame, 4 to a cushion ring, 5 to an actuating member, 6 to a space guide, 7 to a plate member mounted on the actuating member 5, 8 to a cushion member mounted on the plate member 7, 9 to a spring shaft, 10 to a rotating disc for driving the connecting frame 3, 11 to rollers rotatably supported on the rotating disc 10, 12 to a motor output shaft, 13 to a screw receptacle, 14 to a spring adjusting knob, 14A to a spring adjusting screw, 15 to a motor, 16 to a lead wire, 17 to a spring, 18 (FIG. 5) to a control box, 19 (FIG. 5) to a switch, 20 (FIG. 5) to a speed control knob, 21 to a reduction gear assembly, 22 (FIG. 6) to a switch, 23 (FIG. 6) to a positive terminal, 24 (FIG. 6) to an electrically conductive metal strip, 25 (FIG. 6) to batteries, 26 (FIG. 6) to a negative terminal, and 27 (FIG. 6) to a battery cap.

Figure 2:
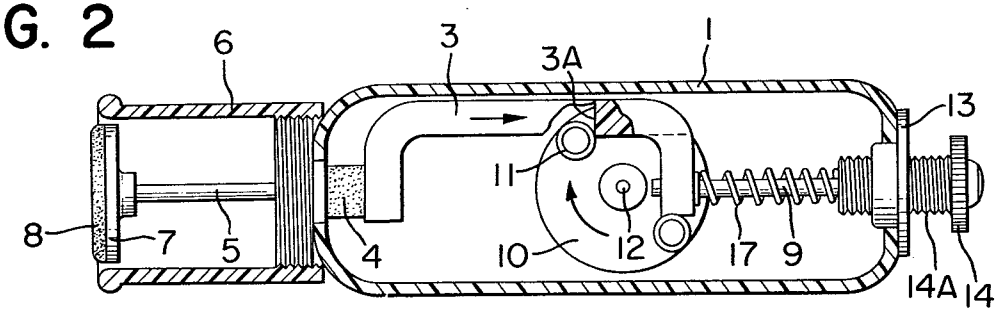
FIGS. 2 through 4 are horizontal sectional views illustrating the operation of the beauty treatment device embodying this invention.
Figure 3:
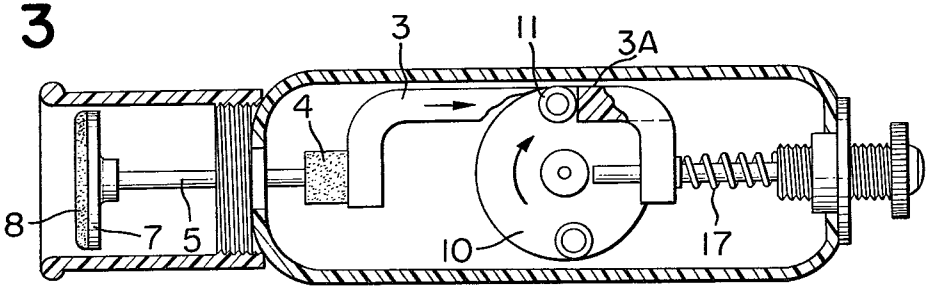

The device body 1 has the handle 2, constructed in a cylindrical or pistol-like shape. The motor 15 is provided in the handle 2 to rotate the motor output shaft 12 via the reduction gear assembly 21. The rotating disc 10 is fixed to the motor output shaft 12, and is rotated to the direction shown by arrows in FIGS. 2 and 3 by the rotation of the motor output shaft 12. As shown in FIGS. 1 through 3, the connecting frame 3 is slidably disposed above the rotating disc 10 and along the spring shaft 9. As the rotating disc 10 rotates, the roller 11 moves on the circumference of the rotating disc 10, and engages with the hook portion 3A provided on the bottom surface of the connecting frame 3 as shown in FIGS. 2 and 3 to drive the connecting frame 3 to the direction shown by arrows in the figures. In other words, the connecting frame 3 slides along the spring shaft 9 while compressing the spring 17.

Figure 4:
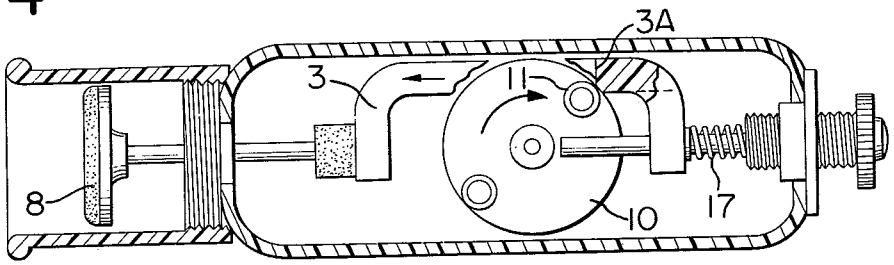

When the rotating disc 10 rotates from the state shown in FIG. 3 to the state shown in FIG. 4, the roller is disengaged from the hook portion 3A on the bottom surface of the connecting frame 3. Thereby the spring 17 rapidly expands and the connecting frame 3 moves to the direction shown by an arrow in FIG. 4 (leftward in the figure). Accordingly, the actuating member 5 also moves leftward (in the figure) and the plate member 7 and the cushion member 8 slightly protrude from the end face of the space guide 6, as shown in FIG. 2. At this time, the cushion ring 4 collides with the inner surface of the device body 1, serving to absorb shock against the connecting frame 3, as shown in FIG. 2. The roller 11 smoothly disengages from the hook portion 3A, as shown in FIG. 4, because the roller 11 is rotatably supported on the rotating disc 10.

As the motor 15 rotates, the roller 11 alternately engages with and disengages from the hook portion on the connecting frame 3, permitting the plate member 7 and the cushion member 8 provided on the actuating member 5 to repeatedly reciprocate. The spring 17 is disposed between the connecting frame 3 and the spring adjusting screw 14A, whereby the intensity of the spring in compressed state as shown in FIG. 4 can be adjusted by rotating the spring adjusting knob 14.

Figure 5:
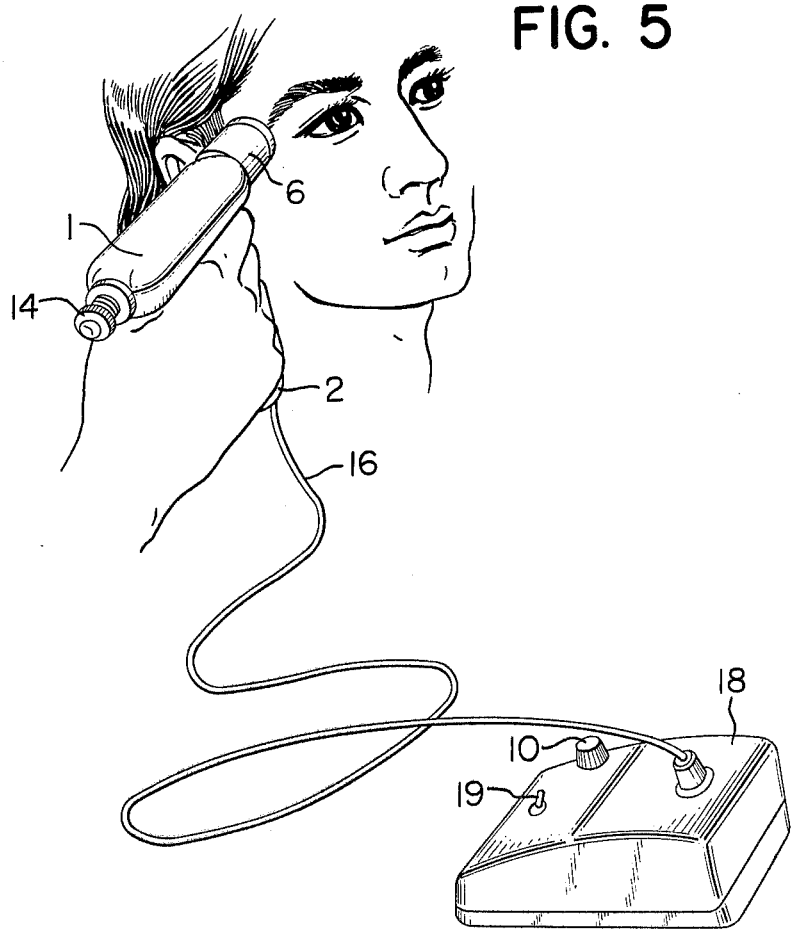
FIG. 5 is a pictorial view illustrating the beauty treatment device in practical use.

The beauty treatment device of this invention is constructed in the manner described above, and the method to use it is illustrated in FIG. 5. In the case of this invention, the device body 1 is held by hand, as shown in FIG. 5, and the space guide 6 is placed on the skin of, for example, the face.

In this state, when the switch 19 is turned on, the motor 15 is energized by the battery device housed in the control box 18 via the lead wire 16. As the motor 15 begins to rotate, the plate member 7 and the cushion member 8 mounted on the actuating member 5 and slightly protruded from the end face of the space guide 6 begin to tap the skin on which the space guide is placed. The rate of tapping action can be freely selected by adjusting the speed adjusting knob 20, that is, by adjusting the voltage supplied to the motor 15. The intensity of tapping action can also be freely selected from the spring adjusting knob 14.

The beauty treatment device of this invention can be used to exercise subcutaneous muscular systems and prevent the skin from slackening by uniformly tapping the skin over the entire face. In this invention, the space guide 6 serves to maintain the distance between the device body 1 and the skin when it is used in the manner as shown in FIG. 5. In the absence of the space guide 6, the above-mentioned distance would vary with the condition of practical use, and the intensity of tapping action would also fluctuate. And, in some cases, the plate member 7 and the cushion member 8 would be in contact with the skin at all times, applying a depressing force on the skin as a reaction of the force pushing up the device body 1 against the skin.

Figure 6:
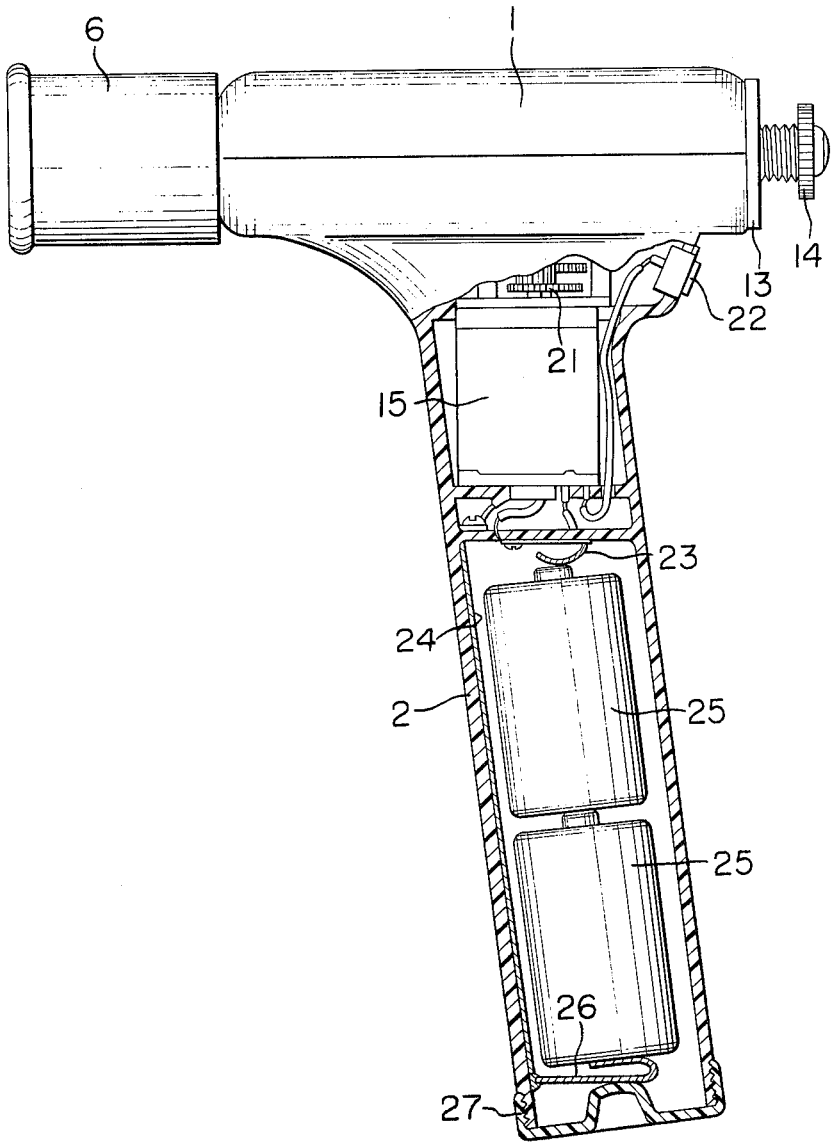
FIG. 6 is a cross section of another embodiment of this invention.

FIG. 6 illustrates another embodiment of this invention. In the figure, batteries 25 are housed in the handle 2, together with the motor 15. In the case of this embodiment, when the switch 22 is turned on, there is formed an electric circuit connecting the positive terminal contacting the batteries 25, the switch 22, the positive terminal of the motor 15, the negative terminal of the motor 15, the electrically conductive metal strip 24, the negative terminal 26 contacting the batteries 25 and the batteries 25, and thus the motor 15 is driven. The battery cap 27 serves as a lid to cover the handle 2 in which the batteries are housed and to depress the negative terminal 26 toward the batteries 25.

In the third embodiment shown in FIGS. 7 through 10, numeral 31 refers to a device body, 32 to a handle, 33 to a square connecting frame at the rear end of which a protrusion 33A protruding downward is provided. Numeral 34 refers to a cushion ring, 35 to an actuating member, 36 to a space guide. The actuating member 35 is fixed to the tip of the square connecting frame 33 with a screw, or a fastener 33B, and slidably extends into the space guide 36 through the cushion ring 34 and a bearing 36A provided at one end of the space guide 36. The space guide 36 is replaceably screwed on the threaded part of the space guide end plate 36B which is fixed to the device body 31 at the bearing 36A. Numeral 37 refers to a plate member which has a T-shaped longitudinal section. An insert hole 37B is provided on the shaft portion 37A of the plate member 37, and a slotted insert 35A at the tip of the actuating member 35 is inserted into the insert hole 27B to firmly fix the plate member 37 to the actuating member 35. Numeral 38 refers to a cushion member made of a soft sponge-like material fixed to the plate member 37. Numeral 39 refers to a plurality (three in the embodiment shown) of spring shafts which are slidably fitted to the rear end of the connecting frame 33. Numeral 40 refers to a rotating disc, 41 to rollers, 42 to a rotating shaft, 43 to a fine adjustment screw holder, 44 to spring adjusting knobs, 44A to spring adjustment screws, 45 to a motor, 46 to a lead wire, 47 to springs, 48 to a spring holder, 49 to a knob, 50 to a latch plate, 51 to an L-shaped slot, 52 to a reduction gear assembly. The spring holder 48 is fixed to the tip of the spring shaft 39. The knob 49 fixed to the spring holder 48 protrudes through the L-shaped slot on the latch plate 50 provided on the rear end of the device body 31. The rear end of the spring shaft 39 is fixedly inserted into the hole provided on the spring adjusting knob 44. The spring adjusting knob 44 and the spring adjusting screw provided on the periphery thereof are screwed into the fine adjustment screw holder 43. The spring 47 is fitted on the spring shaft 39 between the spring holder 48 and the spring adjusting knob 44. Furthermore, one or more rollers are rotatably supported on the rotating disc 40.

The device body 31 has the handle 32, forming a pistol shape, for example, but they can be of cylindrical shape, as a whole. The motor 45 provided in the handle 32 rotates the rotating shaft 42 via the reduction gear assembly 52. The rotating disc 40 is fixed to the rotating shaft 42, and is rotated to the direction shown by an arrow in the figure as the rotating shaft 42 rotates. Rollers 41 are provided on the rotating disc, and, as shown in FIGS. 7 through 10, one of the rollers 41 engages with the protrusion 33A protruding on the bottom surface of the connecting frame 33 to drive the connecting frame 33 to the direction shown by an arrow (rightward) in FIG. 10. In other words, the connecting frame 33 slides along the spring shaft 39 while compressing the spring 47.

Figure 8:
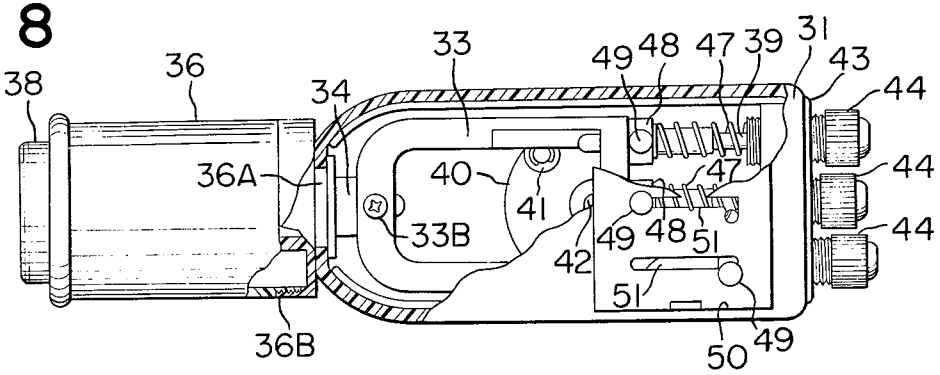
FIG. 7 is a sectional side elevation of a still further embodiment of this invention and FIG. 8 is a horizontal sectional view of the embodiment shown in FIG. 7.
Figure 7:
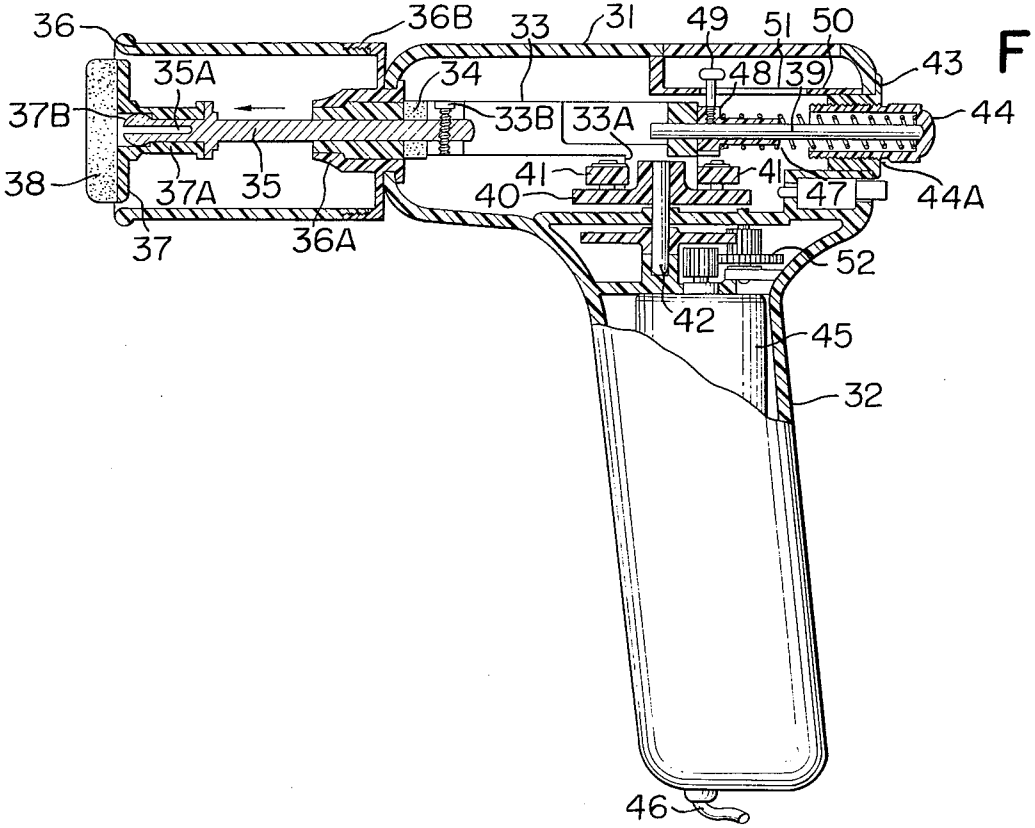
Figure 9:
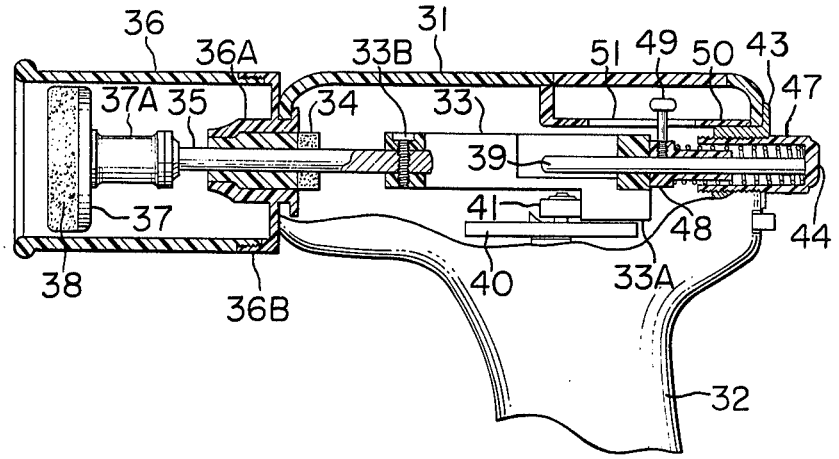
FIG. 9 is a sectional side elevation of the beauty treatment device of this invention shown in FIG. 7 in which the spring is in compressed state.
Figure 10:
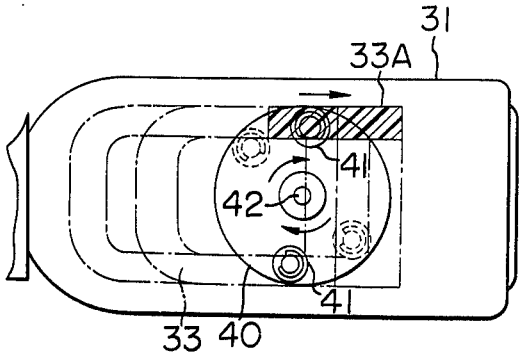
FIG. 10 is a fragmentary horizontal sectional view of the same device with the spring in compressed state.

As the rotating disc 40 rotates further from the state shown in FIGS. 9 and 10, the roller 41 disengages from the protrusion 33A provided on the connecting frame 33. Thereby, the spring 47 rapidly expands and the connecting frame 33 moves to the position shown by broken lines (leftward) in FIG. 10. The actuating member 35 accordingly moves to the direction shown by an arrow (leftward) in FIG. 7, and the plate member 37 and the cushion member 38 slightly protrudes from the end face of the space guide 36, as shown in FIGS. 7 and 8, and at this time, the cushion member 38 made of a soft sponge material taps the cheek as lightly as puffing, and the sponge is compressed to the extent that it protrudes by 2 mm from the end face of the space guide 36. The cushion ring 34 provided on the actuating member 35 hits against the inside of the device body 31, as shown in FIGS. 7 and 8, serving as a cushion to the connecting frame 33. The rollers 41 are rotatably supported on the rotating disc 40 so that the rollers can smoothly disengage from the protrusion 33A.

As the motor 45 rotates, the rollers alternately engages with and disengages from the protrusion 33A on the connecting frame 33, wherein the plate member 37 and the cushion member 38 provided on the actuating member 35 repeatedly reciprocate. Since the spring 47 is disposed between the connecting frame 33 and the tip of the spring adjusting screw 44A, the intensity of the compressed spring can be adjusted by rotating the spring adjusting knob 44. When the beauty treatment device according to this invention is used at different positions of the face, for example, the cheek and the corner of the eye, it is necessary to change the diameter of the space guide 36. Therefore, in this invention, the space guides 36, the plate members 37 and the cushion members 38 of different diameters are made available and replaced with the most suitable one, depending on the position to be treated, by means of the space guide end plate 36B and the insert end 35A of the actuating member 35. When parts of smaller diameter are used, the intensity of tapping action must be reduced accordingly. However, only one unit of the spring 47 is insufficient for such a purpose because of the narrow range of adjustment. To cope with this, a plurality (for example, three units) of the springs 47 with different strengths (strong, medium, and weak) are provided in this invention. The heads of the fastening screws of these springs are engaged with the latch parts (located at the end of each slot) of the L-shaped slots 51 to hold the springs 47 in the compressed state, disabling the springs 47 from pushing the connecting frame 33. Thus, several kinds of the intensity of tapping action can be obtained by combining the springs 47 of different strengths (strong, medium, weak, weak+medium, weak+strong, medium+strong weak+medium+strong). Furthermore, fine adjustment is accomplished by means of the spring adjusting knob 44, ensuring a wide adjustment range in which the springs can be adjusted in accordance with the diameter of the actuating member 5.

In this way, the beauty treatment device of this invention shown in FIGS. 7 through 10 has such a construction as described above. In practical use, the handle 32 of the device is held by hand, placing the space guide 36 on the skin of the face. When the switch (not shown) is turned on, power is supplied from the battery device (not shown) to the motor 45 via the lead wire 46 to drive the motor 45. Then, the plate member 37 and the cushion member 38 attached to the actuating member 35, which slightly protrude from the end face of the space guide 36, tap the skin covered by the space guide 36. The speed of tapping action can be freely selected by adjusting the voltage supplied to the motor 45. And, the intensity of the tapping action can be freely selected by the spring adjusting knob 44 and/or the latch mechanism described above.

The beauty treatment device of this invention can be used to exercise the subcutaneous muscular systems of the face and to prevent the skin from slackening by uniformly tapping the entire face. In this invention, the space guide 36 serves to maintain the distance between the device body 31 and the skin. In the absence of the space guide 36, the above-mentioned distance would vary with the condition of practical use, and the intensity of tapping action would also fluctuate. And, in some cases, the plate member 37 and the cushion member 38 would be in contact with the skin at all times, applying a depressing force on the skin as a reaction of the force pushing up the device body 31 against the skin.

In the above-mentioned embodiments, the device of such a construction that one or more springs are compressed to one direction and released using a motor have been disclosed, but it is to be understood that this invention is not limited to them. The actuating member of the device of this invention may be reciprocated by the output of a push-pull circuit incorporated in the device body, and a solenoid may be used in place of a motor to drive the actuating member. Furthermore, the reciprocating action of the connecting frame and the vibration of the springs may be brought into resonance to reciprocate the plate member and the cushion member. In addition, a mechanical power source, for example, a spring, may be used to drive the connecting frame, and a piston or other means may be used to produce a reciprocating action.

As described above, the beauty treatment device of this invention can repeatedly tap the skin with its plate member and cushion member to remove subcutaneous fat, to exercise subcutaneous muscular systems, and to prevent the skin from slackening and wrinkling. Moreover, the effect of beauty treatment can be enhanced by making it possible to finely adjust the strength of the spring in accordance with the diameter of the actuating member since the device has such a construction that a plurality of the spring adjusting knobs 44 are provided and each adjusting knob 44 can be separately latched to adjust the strength of the springs.

The beauty treatment device of this invention is used not only for facial treatment but also to facilitate the circulation of blood around the muscles at the shoulder and waist and to prevent the breast from drooping by giving a stimulus to the upper part of the breast.

It can be said that "tapping action" as referred to in this invention is derived from (1) the fact that the plate member 7, 37 provided on the actuating member slightly protrudes from the end face of the space guide 6, 36, and (2) the fact that the means acting on the skin is formed by the plate member 7, 37. If the means acting on the skin is formed in a hemispheric shape, the depressing force is directed vertically to the depth under the skin while a plate member as used in this invention acts on the skin mainly to the horizontally dispersing direction.

What is claimed is:

1. A beauty treatment device for the skin comprising a device body, a drive unit including a motor provided in said device body, acutating means disposed in said device body, at least one spring shaft slidably coupled to said actuating means, at least one spring, said spring being disposed about said spring shaft with one end of said spring contacting said actuating means, adjusting means secured to the other end of the said spring for varying the energy stored therein, means for releasing the energy of said spring whereby said spring drives said actuating means, a plate member mounted on said acutating means, a cushion member mounted on a surface of said plate member and an open ended space guide mounted on said device body for maintaining the range of the movement of said actuating means whereby said actuating means, said plate member, and said cushion member are arranged to repeatedly tap the skin.

2. A beauty treatment device as set forth in claim 1 wherein a handle is provided so as to form a pistol-like shape.

3. A beauty treatment device as set forth in claim 1 wherein said drive unit further comprises an electric motor having a rotatable output shaft, a reduction gear assembly and a rotating shaft.

4. A beauty treatment device as set forth in claim 1 wherein there is provided a plurality of said spring shafts and a plurality of springs each of which is disposed on one of said spring shafts with one end of each said spring contacting said actuating means via a spring holder and with the other end of each said spring being fixed to a spring adjusting knob, and a holding means for separating said spring holder from said actuating means and holding said spring holder in the separated state so as to hold said springs in the compressed state.

5. A beauty treatment device as set forth in claim 3 wherein there is further provided at least one roller on a rotating disc mounted on said rotatable output shaft of said motor.

6. A beauty treatment device as set forth in claim 1 wherein a plate member with a T-shaped cross section having a cushion member on its surface is mounted on the front end of said actuating means in such a manner that the surface of the plate member slightly protrudes from the open end of said space guide, and a U-shaped connecting frame is provided on the rear end of said actuating means, and said spring shaft with said spring connecting frame.

7. A beauty treatment device as set forth in claim 6 wherein said connecting frame includes a protrusion and wherein said one roller repetitively engages and disengages said protrusion whereby said actuating means is reciprocated.

8. A beauty treatment device as set forth in claim 1 wherein the open end of said space guide contacts the skin.

9. A beauty treatment device as set forth in claim 1 wherein said plate member provided on said acutating means and said space guide are removable and replaceable.

10. A beauty treatment device as set forth in claim 1 wherein batteries are housed in said device body as an energy source.

11. A beauty treatment device as set forth in claim 1 wherein a control box having battery means, a switch and speed control knob are provided to control the speed of tapping action by controlling said motor in said device body.

* * * * *